US005386886A

United States Patent [19]

Kobayashi et al.

[11] Patent Number: 5,386,886

[45] Date of Patent: Feb. 7, 1995

[54] ELEVATOR DOOR LOCK MECHANISM

[75] Inventors: Osamu Kobayashi, Yotsukaido; Ryuichi Ishibashi, Chiba, both of Japan

[73] Assignee: Otis Elevator Company, Farmington, Conn.

[21] Appl. No.: 112,486

[22] Filed: Aug. 27, 1993

[51] Int. Cl.[6] ..... B66B 13/00

[52] U.S. Cl. ..... 187/335; 49/120

[58] Field of Search ..... 187/57, 61; 49/116, 49/120

[56] References Cited

U.S. PATENT DOCUMENTS 3,315,767 4/1967 Walter ..... 187/57

3,638,762 2/1972 Johns ..... 187/61

FOREIGN PATENT DOCUMENTS 0233493 9/1990 Japan ..... 187/61

*Primary Examiner*—Kenneth W. Noland

[57] ABSTRACT

A door lock mechanism for a sliding door is provided comprising a pivotly mounted first lock member, a second lock member, and a mechanism for selectively engaging the first lock member. The mechanism for selectively engaging the first lock member may be operated to pivot the first lock member away from the second lock member, thereby uncoupling the lock members and permitting the sliding door to be opened.

9 Claims, 4 Drawing Sheets

ELEVATOR DOOR LOCK MECHANISM

BACKGROUND OF THE INVENTION a. Technical Field

This invention relates to door locks for laterally moving doors in general, and to door locks for laterally moving elevator doors in particular.

b. Background Art

Horizontal elevators, also known as shuttles, are a popular way of moving large volumes of people along a particular path in a short period of time. The path traveled typically consists of a number of stations having docks where passengers can enter and exit the shuttles. Because of the large volume of people passing through the shuttle stations and the chance for accidents, it is desirable to partition the edge of the station docks adjacent the shuttle path with walls and doors. The walls and doors separate the shuttles and the passengers and thereby prevent accidental contact.

It is known in the art to provide a door opening system that laterally opens the station doors when the shuttle has docked. Typically, the door opening system includes a position sensor and a drive mechanism for opening the station doors. When the shuttle has arrived at the proper position relative to the station doors, the position sensor sends a signal to a controller that it is safe to open the doors. The controller, in turn, instructs the drive mechanism to open the doors and allows access to the shuttle.

When the shuttle is not docked at the proper position, or is not at the station at all, the doors must be kept closed to avoid an unsafe situation. Hence, it is necessary to have a lock means to lock the doors until the shuttle docks in its proper position.

DISCLOSURE OF THE INVENTION

It is, therefore, an object of the present invention to provide a door lock for a lateral motion door which automatically locks upon closing the door.

It is a further object of the present invention to provide a door lock for a lateral motion door which is normally locked when the door is closed.

It is a still further object of the present invention to provide a door lock for a lateral motion door that may be selectively uncoupled to allow the door to be opened.

It is a still further object of the present invention to provide a door lock for a lateral motion door having means for sensing if the door is locked.

According to the present invention, a door lock mechanism for a lateral motion door is provided comprising a pivotly mounted first lock member, a second lock member, and means for selectively engaging the first lock member. The means for selectively engaging the first lock member may be operated to pivot the first lock member away from the second lock member, thereby uncoupling the lock members and permitting the lateral motion door to be opened.

According to one aspect of the present invention, a sensing means is provided for determining whether the first and second lock members are coupled.

According to another aspect of the present invention, a sensing means is provided for determining whether the first and second lock members are uncoupled.

According to still another aspect of the present invention, the means for selectively engaging the first lock member comprises a means for pivoting the first lock member and means for damping the motion of the first lock member.

An advantage of the present invention is that the door lock automatically locks upon closing the door.

A further advantage of the present invention is that sensing means is provided which indicates whether the lock members are coupled or not.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
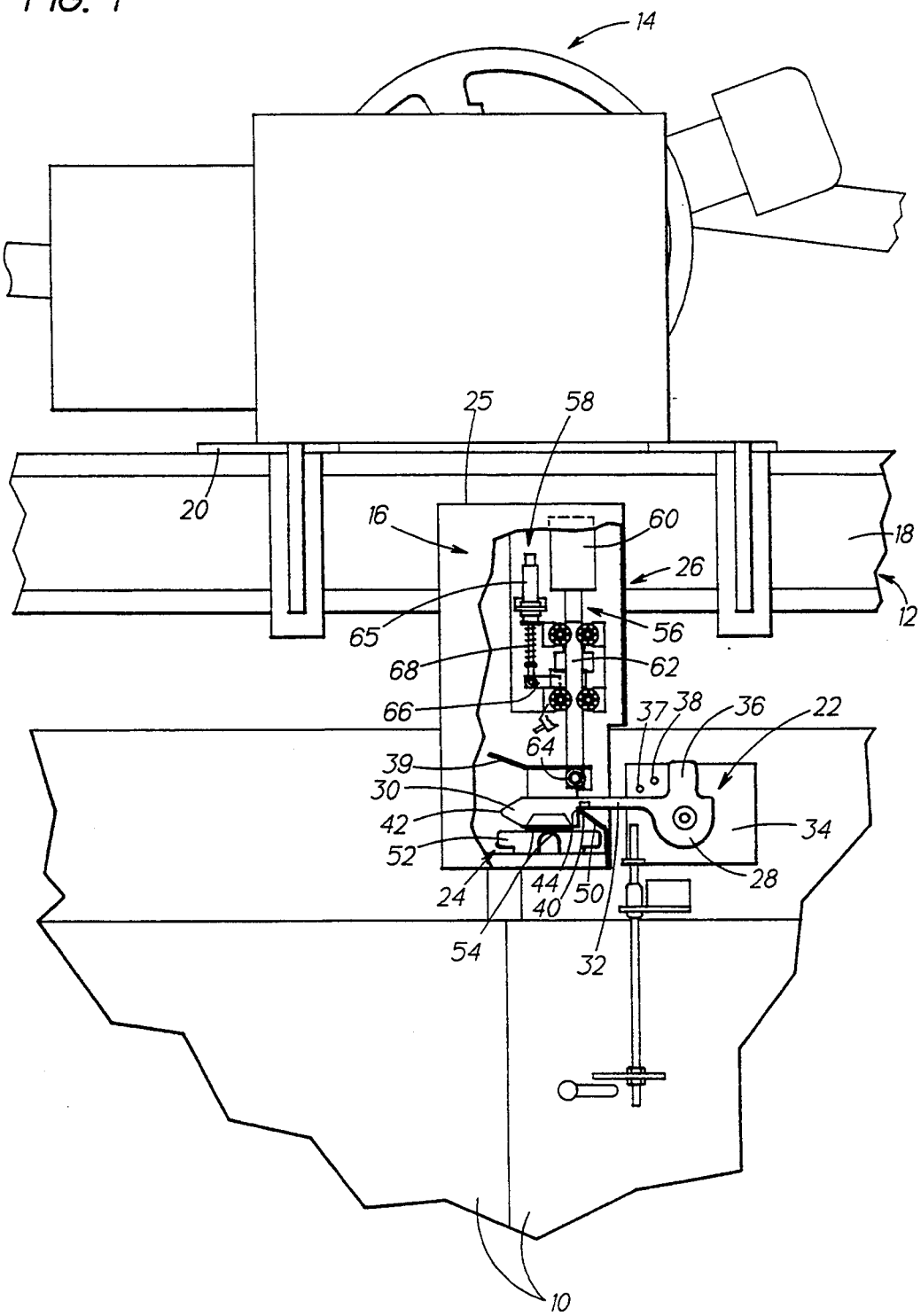
FIG. 1 is a diagrammatic view of a laterally opening station door assembly having a door drive machine, and a lock mechanism.

Now referring to FIG. 1, a station for a horizontal elevator (not shown) includes a pair of laterally moving doors 10 (also known as "sliding" doors), a support frame 12, a door drive machine 14, and a door lock mechanism 16 for a sliding door 10. It is known in the art that the sliding doors may comprise steel panels suspended from rollers (not shown) which ride on rails. Above the doors 10, the support frame 12 comprises a beam 18 and a shelf 20 attached thereto. The door drive machine 14 is attached to the top of the shelf 20.

A person of ordinary skill in the art will recognize that there are many different door drive machines 14 available. In elevators having twin doors, both doors are typically coupled and driven by a single drive machine 14. In other words, when the drive machine 14 operates, the linkage (not shown) moves each door away from the other and neither door can be moved independently. Alternatively, in a single door application, the door drive machine 14 drives the door away from a fixed door jam.

The door lock mechanism 16 comprises a first lock member 22, a second lock member 24, means 26 for selectively engaging the first lock member 22, and a housing 25.

Figure 2:
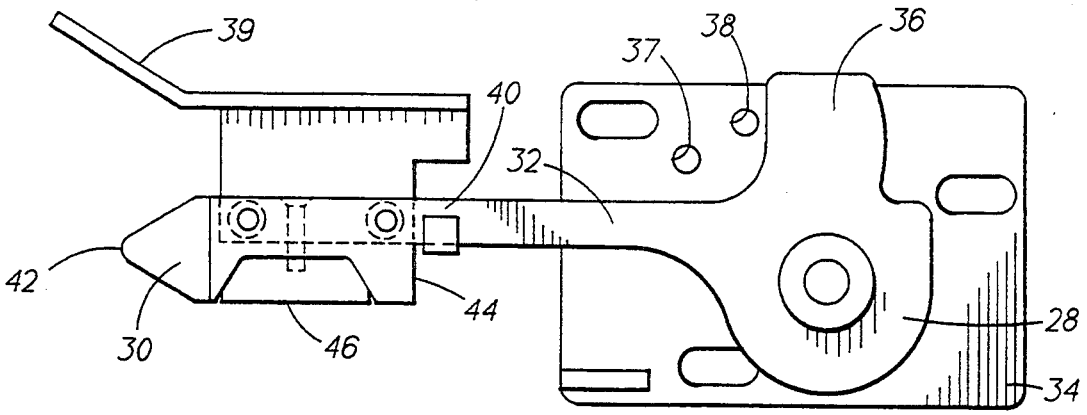
FIG. 2 is a diagrammatic view of the first lock member shown in FIG. 1.

Referring to FIGS. 1 and 2, the first lock member 22 includes a body 28, a weight 30, an arm 32, a mounting plate 34, a spur 36, a pair of stops 37,38, and a cam surface 39. The body 28 is pivotly attached to the mounting plate 34 by conventional means. The spur 36 and the arm 32 attach to, and extend out from the body 28 at right angles to one another. The weight 30 attaches to the end 40 of the arm 32 opposite the body 28. One end of the weight 30 has a tapered surface 42 and the other end forms a surface 44 perpendicular to the arm 32. A plate 46 of electrically conductive material, as a first portion of the sensing means, attaches to the bottom of the weight 30 between the tapered surface 42 and the perpendicular surface 44. In a twin sliding door 10 application, the first lock member 22 can be attached to either sliding door. In a single sliding door application, the first lock member 22 is attached to the only sliding door.

Referring to FIG. 1, the second lock member 24 includes a ramp surface 50, a pad 52, and a pair of electrically conductive terminals 54, as a second portion of the sensing means, extending out from the pad 52. The ramp surface 50 and the pad 52 are attached to the housing 25 adjacent one another. Specifically, the ramp surface 50 is attached to the side of the pad 52 closest to the first lock member 22 and extends over the pad 52 at an acute angle relative to the pad 52.

The means 26 for selectively engaging the first lock member 22 includes means 56 for pivoting the first lock member 22 and means 58 for damping the motion of the first lock member 22. The means 56 for pivoting the first lock member 22 includes an electromagnetic solenoid 60 having a rod 62 that extends outwardly. A bearing 64 is attached to the end of the rod 62 extending out from the solenoid 60. A person of ordinary skill in the art will recognize that there are other means available for imparting linear motion to a rod 62, such as linear motors, hydraulic motors, pneumatic motors, and others.

The means 58 for damping the motion of the rod 62 comprises a shock absorber 65 mounted adjacent the rod 62, and a first flange 66 attached to both the rod 62 and the shock absorber 65. The shock absorber 65 is a pneumatic dashpot having a shaft 68 extending outwardly. The first flange 66 attaches to the shaft 68. A person of ordinary skill in the art will recognize that other types of damping mechanisms are available and may be used alternatively.

Figure 3:
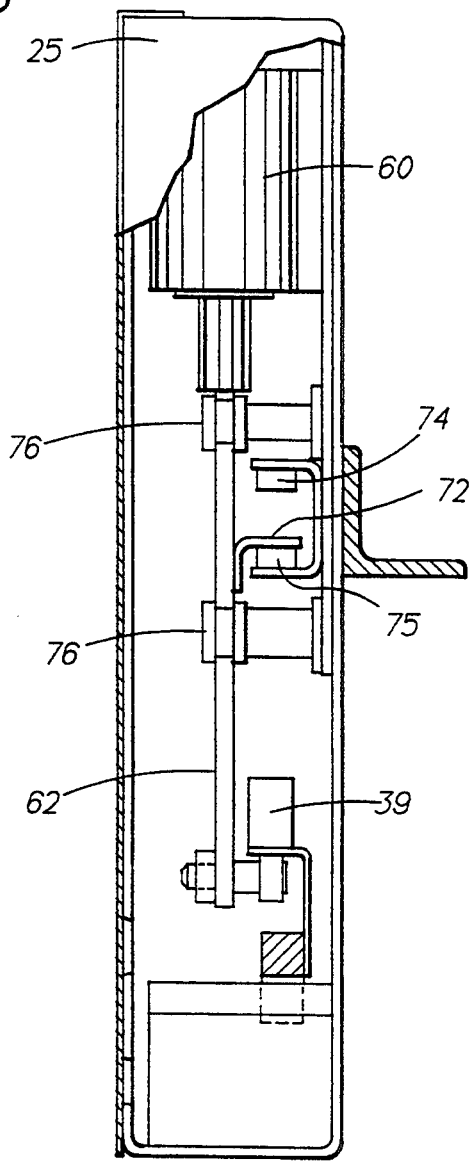
FIG. 3 is a side view of the lock mechanism shown in FIG. 1.

Referring to FIG. 3, the travel of the rod 62 is limited by a second flange 72 attached to the rod 62 and a pair of bumpers 74,75 attached to the housing 25, spaced apart by a specific distance. The second flange 72 attached to the rod 62 is positioned in between the two bumpers 74,75. A plurality of rollers 76, positioned on opposite sides of the rod 62, guide the rod 62.

Referring to FIG. 1, the housing 25 and attached elements may be attached to a variety of places, depending on the application. In a twin door 10 application, the housing 25 may be attached to the support frame 12 above the doors 10 as is shown in FIG. 1. In that case, the housing 25 and attached elements are stationary relative to the first lock member 22 which is attached to one of the sliding doors 10. In another twin door application, the housing 25 may be mounted on one of the sliding doors 10, while the first lock member 22 is attached to the other sliding door. In a single door application, the housing 25 could be attached to the support frame 12 in a manner similar to that shown in FIG. 1. A person of ordinary skill in the art will recognize that the housing 25 and attached elements could be mounted in a variety of ways.

Referring to FIGS. 1 and 4A–4C, in the operation of the elevator, after an elevator car (not shown) has docked at the station and is in the correct position, a signal is sent to unlatch the door lock mechanism 16. Upon receipt of the signal, the solenoid 60 is energized and the rod 62 is drawn upward, within the solenoid 60. The rod 62 travels upward until the second flange 72 (see FIG. 3) attached to the rod 62 contacts the upper bumper 74. The motion of the rod 62 is damped by the shock absorber 65 attached to the rod 62 by the first flange 66.

As the rod 62 moves upwardly, the bearing 64 attached to the end of the rod 62 causes the cam surface 39 and attached arm 32 to pivot upwardly. The arm 32 is drawn upward until the perpendicular surface 44 of the weight 30 is above the ramp surface 50 of the second lock member 24. At this point, the lock members 22,24 are uncoupled and the doors may be drawn apart.

Figures 4A, 4B, 4C:
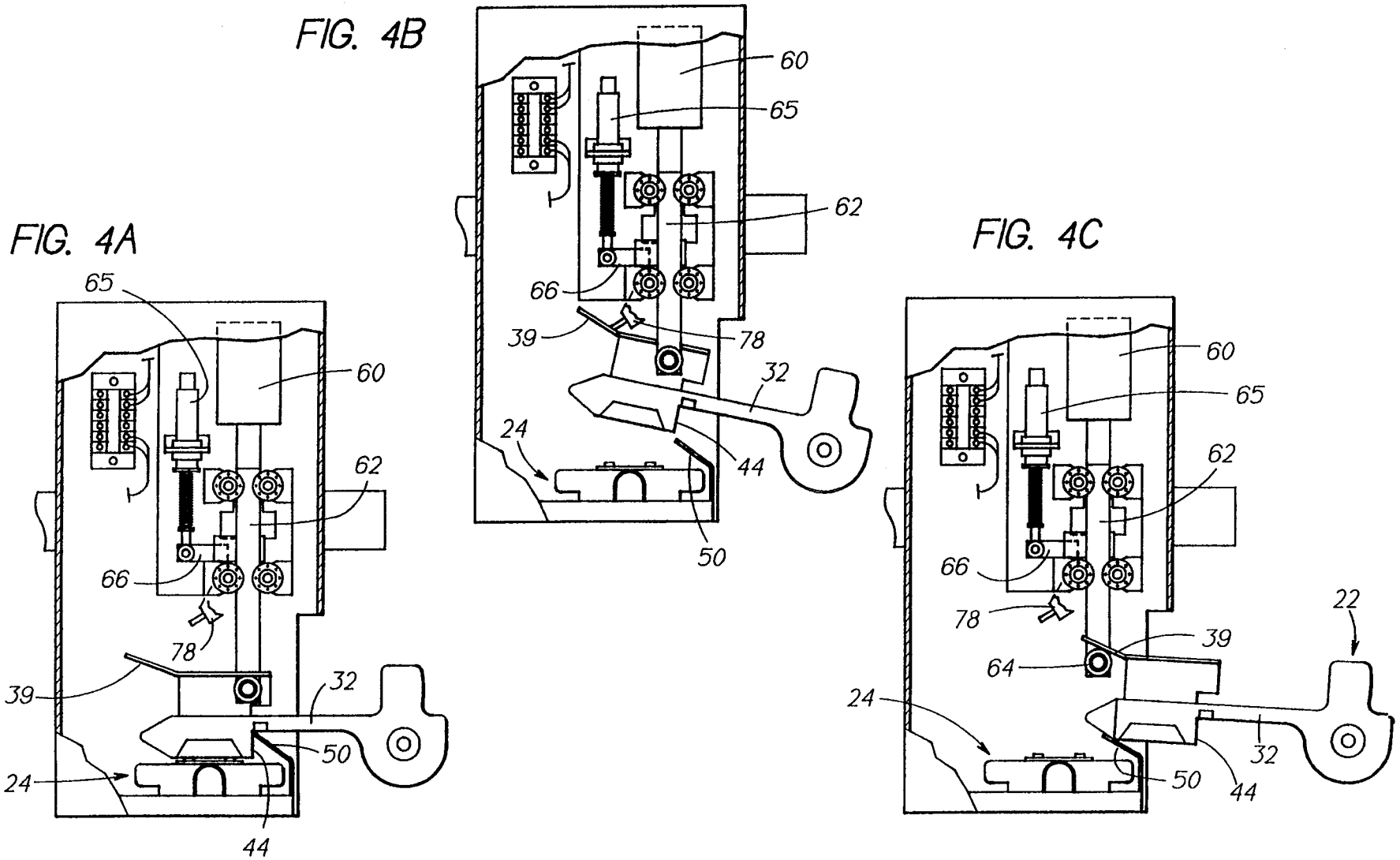
FIGS. 4A–4C are diagrammatic sequential views of the lock mechanisms shown in FIG. 1, shown sequentially uncoupling.

Referring to FIGS. 4A–4C, in one embodiment an electrical switch 78 or contact is attached to the housing 25 at a position in the path of the upwardly rotating arm 32. When the arm 32 is sufficiently rotated to allow the weight 30 to pass by the ramp surface 50, the switch 78 or contact is actuated. The actuated switch 78 or contact "tells" a controller (not shown) that the lock members 22,24 are uncoupled completely and the doors 10 may be opened without damaging the lock members 22,24.

Referring to FIG. 2, one of the stops 37 attached to the mounting plate 34 prevents the first lock member 22 from rotating past a certain point. The other stop 38 maintains the first lock member 22 is a horizontal position when the lock members 22,24 are uncoupled.

Figures 5A, 5B, 5C:
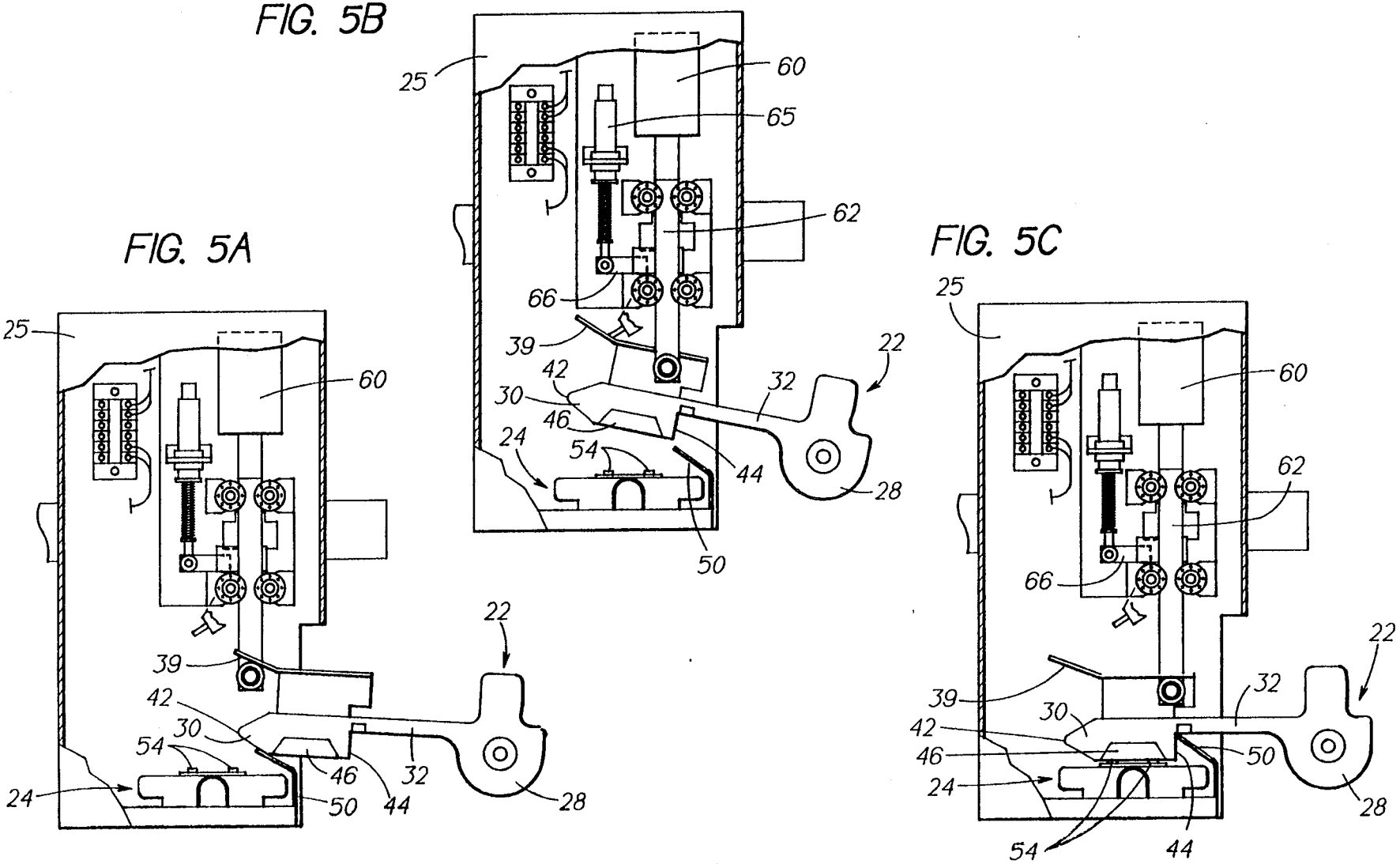
FIGS. 5A–5C are diagrammatic sequential views of the lock mechanisms shown in FIG. 1, shown sequentially coupling.

Referring to FIGS. 5A–5C, when the doors are closing, the horizontally positioned first lock member 22 approaches the second lock member 24 which is substantially enclosed within the housing 25. In this position, the solenoid 60 of the selective engagement means 26 is not energized and the second flange 72 (see FIG. 3) attached to the rod 62 rests on the lower bumper 75.

Upon entering the housing 25, the tapered surface 42 of the weight 30 contacts the ramp surface 50 of the second lock member 24. The ramp surface 50 causes the weight 30, arm 32, and cam surface 39 to pivot upwardly. When the door travels far enough, the perpendicular surface 44 of the weight 30 will pass the end of the ramp surface 50. At that point, the first lock member 22 will pivot downwardly and bring the conductive plate 46 into contact with the terminals 54 of the second lock member 24. The lock members 22,24 are coupled in this position and cannot be laterally separated. The contact between the conductive plate 46 and the terminals 54 causes a signal to be sent indicating that the lock members 22,24 are coupled. The perpendicular surface 44 of the weight 30 prevents the arm 32 of the first lock member 22 from being drawn past the ramp surface 50.

Although this invention has been shown and described with respect to the detailed embodiments thereof, it will be understood by those skilled in the art that various changes in form and detail thereof may be made without departing from the spirit and scope of the claimed invention.

We claim:

1. A door lock mechanism for a sliding door of an elevator, comprising:

a first lock member, pivotly mounted, having an arm, said arm having a weight attached to an end, said arm also having a tapered surface at one end and a perpendicular surface at another end, a first portion of sensing means being disposed intermediate of said tapered surface and said perpendicular surface, and a cam surface attached to said arm;

a second lock member, having a second portion of said sensing means; and means for selectively engaging said cam surface of said first lock member;

wherein said engaging means may be selectively operated to pivot said first lock member away from said second lock member, thereby uncoupling said lock members and permitting said sliding door to be opened, and said cam surface is guided by said engaging means when said arm of said first lock member is pivoted away from said second lock member.

2. A door lock mechanism for a sliding door, according to claim 1, wherein said second lock member further comprises:

a pad; and a ramp surface, extending above said pad at an acute angle relative to said pad;

wherein said ramp surface maintains said lock members in a coupled relationship when the sliding door is closed.

3. A door lock mechanism for a sliding door according to claim 2, wherein said first portion of sensing means comprises a conductive member, attached to said arm of said first lock member, and said second portion of sensing means comprises a pair of electrically conductive terminals, attached to said pad of said second lock member;

wherein when said arm passes over said ramp surface, said weight attached to said arm causes said arm to rotate said conductive member in contact with said conductive terminals attached to said pad.

4. A door lock mechanism for a sliding door according to claim 1, wherein said means for selectively engaging said cam surface, comprises:

means for pivoting said first lock member; and means for damping the motion of said first lock member;

wherein said pivoting means may be selectively operated to pivot said first lock member out of engagement with said second lock member.

5. A door lock mechanism for a sliding door according to claim 4, wherein said means for pivoting said first lock member comprises:

a solenoid, having a housing and a rod, said rod extending out from said housing, said rod having a bearing attached to an end opposite said housing;

means for guiding said rod; and means for limiting the travel of said rod;

wherein energizing said solenoid causes said rod to travel a linear path.

6. A door lock mechanism for a sliding door, according to claim 5, wherein said means for damping said first lock member comprises:

a shock absorber, having a shaft; and a flange, wherein said flange attaches said shaft to said rod of said solenoid.

7. A door lock mechanism for a sliding door, according to claim 4, wherein said means for damping said first lock member comprises:

a shock absorber, having a shaft; and a flange, wherein said flange attaches said shaft to said means for pivoting said first lock member.

8. A door lock mechanism for a sliding door, according to claim 7, further comprising:

means for sensing the position of said first lock member, when said first lock member is in a position where said first lock member may laterally pass over said second lock member, thereby uncoupling said lock members.

9. A door lock mechanism for a sliding door, comprising:

a first lock member, pivotly mounted, having an arm, said arm having a weight attached to an end, said arm also having a tapered surface at one end and a perpendicular surface at another end, a first portion of sensing means being disposed intermediate of said tapered surface and said perpendicular surface, and a cam surface attached to said arm;

a second lock member, having a second portion of said sensing means; and means for selectively engaging said cam surface of said first lock member;

wherein said engaging means may be selectively operated to pivot said first lock member away from said second lock member, thereby uncoupling said lock members and permitting said sliding door to be opened, and said cam surface is guided by said engaging means when said arm of said first lock member is pivoted away from said second lock member.

* * * * *